US007001003B1

(12) United States Patent
Stone

(10) Patent No.: US 7,001,003 B1
(45) Date of Patent: Feb. 21, 2006

(54) ACCESSORY AND DOLL HOLDING ASSEMBLY

(76) Inventor: Cindy J. Stone, 487 Concord Rd., Pewaukee, WI (US) 53072

( * ) Notice: Subject to any disclaimer, the term of this patent is extended or adjusted under 35 U.S.C. 154(b) by 0 days.

(21) Appl. No.: 10/899,580

(22) Filed: Jul. 27, 2004

(51) Int. Cl.
*A47B 81/00* (2006.01)

(52) U.S. Cl. ..... 312/285; 312/249.2

(58) Field of Classification Search ..... 312/283, 312/285, 249.1, 249.2, 249.4, 249.8, 224, 312/225; 211/126.1, 126.7; 206/775, 776, 206/782
See application file for complete search history.

(56) References Cited

U.S. PATENT DOCUMENTS

| | | | | |
|---|---|---|---|---|
| 362,814 A | | 5/1887 | Blackford | |
| 769,615 A | * | 9/1904 | Kosansvich | 215/10 |
| 1,029,709 A | * | 6/1912 | Norrlander | 312/249.4 |
| 1,123,638 A | * | 1/1915 | Wingett | 211/13.1 |
| 1,242,235 A | * | 10/1917 | Polk | 312/213 |
| 2,903,127 A | * | 9/1959 | Dorman | 206/338 |
| 5,505,651 A | | 4/1996 | Coughlin | |
| 5,549,373 A | | 8/1996 | Bustos | |
| 5,651,595 A | * | 7/1997 | Willis | 312/249.2 |
| 5,678,908 A | * | 10/1997 | Wang | 312/264 |
| 6,086,171 A | | 7/2000 | Ashley et al. | |
| 6,244,439 B1 | | 6/2001 | Dennis | |

FOREIGN PATENT DOCUMENTS

| | | | | |
|---|---|---|---|---|
| JP | 40-6141941 | * | 5/1994 | 312/111 |

* cited by examiner

*Primary Examiner*—James O. Hansen

(57) ABSTRACT

An accessory and doll holding assembly includes a base housing with a bottom wall, a top wall and a peripheral wall. A plurality of dividing walls divides the base housing into a two clothes hanging sections and a plurality of drawer sections. A centrally disposed well extends into the top wall. A middle housing and a top housing each include a lower wall, an upper wall and a perimeter wall. A plurality of inner walls divides the middle and top housings into a plurality of compartments. Each of the compartments includes a transparent door extending through the perimeter walls. The upper wall of the middle housing has a centrally disposed well therein. Each one of a pair of posts is attached to and extends down from one of the lower walls of the middle and top housings. Each of the posts may be selectively extended into one of the wells.

10 Claims, 5 Drawing Sheets

ACCESSORY AND DOLL HOLDING ASSEMBLY

BACKGROUND OF THE INVENTION

1. Field of the Invention

The present invention relates to doll holding devices and more particularly pertains to a new doll holding device for holding and displaying a plurality of dolls and for storing a plurality of accessories for the dolls.

2. Description of the Prior Art

The use of doll holding devices is known in the prior art. U.S. Pat. No. 6,244,439 describes a device for holding a plurality of dolls in an upright position. Another type of doll holding device is U.S. Pat. No. 5,505,651 having a collapsible outer wall and which can be hung in a vertical orientation for displaying a doll. Related devices include those such as U.S. Pat. No. 5,549,373 which are used for displaying merchandise in such a manner that the merchandise may be easily viewed.

While these devices fulfill their respective, particular objectives and requirements, the need remains for a device that allows a person to hold a plurality of dolls in a vertical orientation and in such a manner that the dolls are easily viewable within the device. Also, such a device should include a construction allowing for the expansion of the device for holding additional dolls. Finally, the device should include a plurality of drawers or other methods whereby the user may store a plurality of doll accessories such that the accessories are in close proximity to the dolls.

SUMMARY OF THE INVENTION

The present invention meets the needs presented above by utilizing a plurality of compartments within middle and top housings that are capable of each holding a plurality of dolls in a vertical orientation. Additionally, the present invention allows the user to incorporate additional middle houses as needed for the storage of additional dolls.

Another object of the present invention is to provide a new doll holding device that includes a plurality of drawer sections, clothes hanging sections and containers for holding a plurality of doll accessories so that the accessories are positioned in housings adjacent to the dolls.

Still another object of the present invention is to provide a new doll holding device that includes a plurality of transparent doors and inner mirrors for allowing a person to easily view the dolls positioned within compartments found in the housings.

To this end, the present invention generally comprises a base housing with a bottom wall, a top wall and a peripheral wall extending between and attached to the top and bottom walls. A plurality of dividing walls is positioned within the base housing such that a central section is defined and a plurality of outer sections is defined. Each of the outer sections is positioned adjacent to the peripheral wall. Two of the outer sections define clothes hanging sections and a remaining number of the outer sections define drawer sections. The peripheral wall of each of the clothes hanging sections has a substantially transparent door therein. Each of a plurality of drawers is removably extended through the peripheral wall and mounted in one of the drawer sections. A centrally disposed well extends into the top wall. A middle housing and a top housing each include a lower wall, an upper wall and a perimeter wall extending between and attached to the lower and upper walls. A plurality of inner walls is positioned in each of the middle and top housings and radially extends outwardly from a central area to the perimeter walls such that a plurality of compartments is defined. Each of the perimeter walls has a plurality of substantially transparent doors therein for selectively accessing an interior of each of the compartments and each of the compartments includes one of the doors. Each one of a pair of posts is attached to and extends down from one of the lower walls of the middle and top housings. The upper wall of the middle housing has a centrally disposed well therein. The posts may be selectively extended into one of the wells. A handle is attached to the upper wall of the top housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
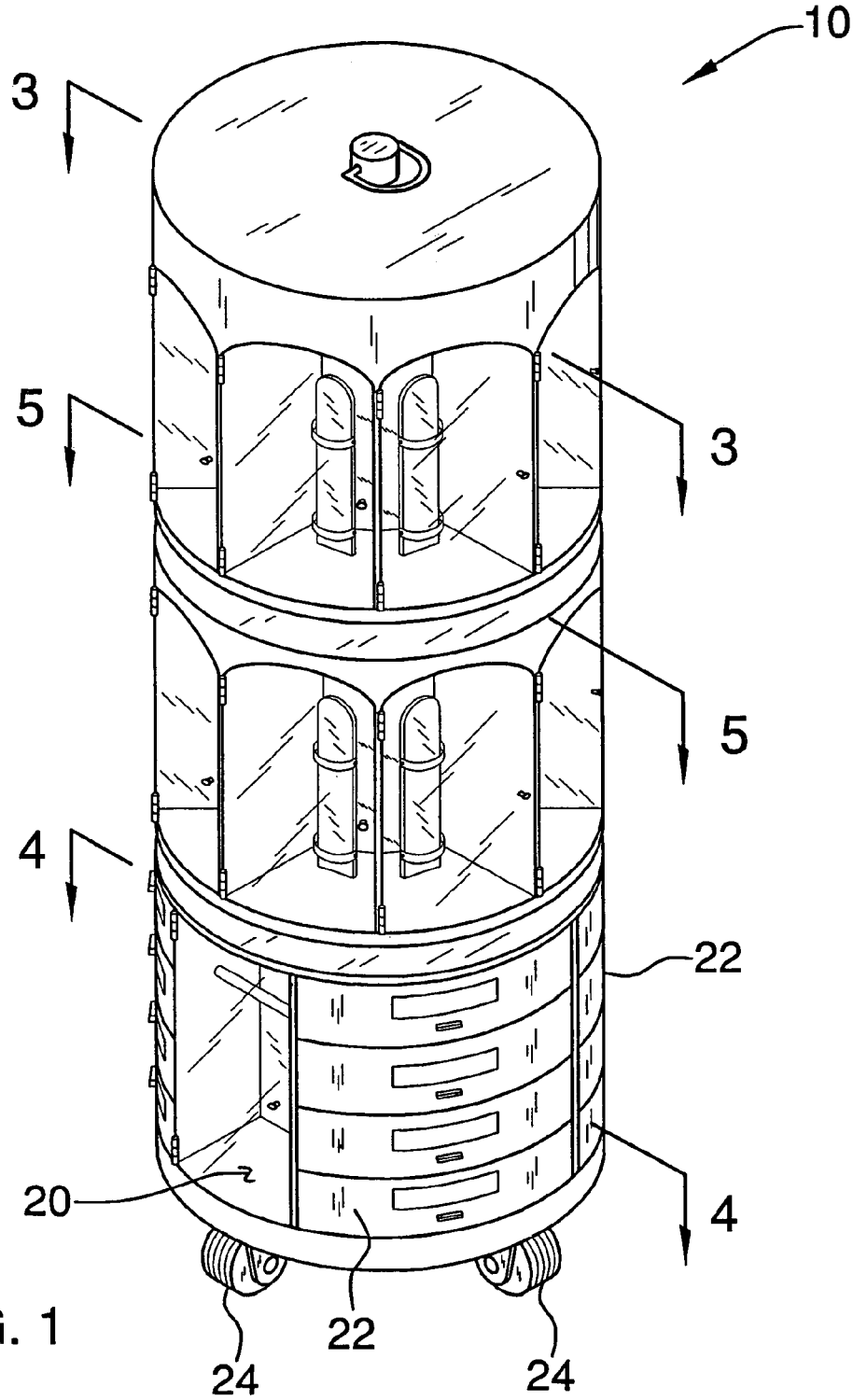
FIG. 1 is a perspective view of a accessory and doll holding assembly according to the present invention.
Figure 2:
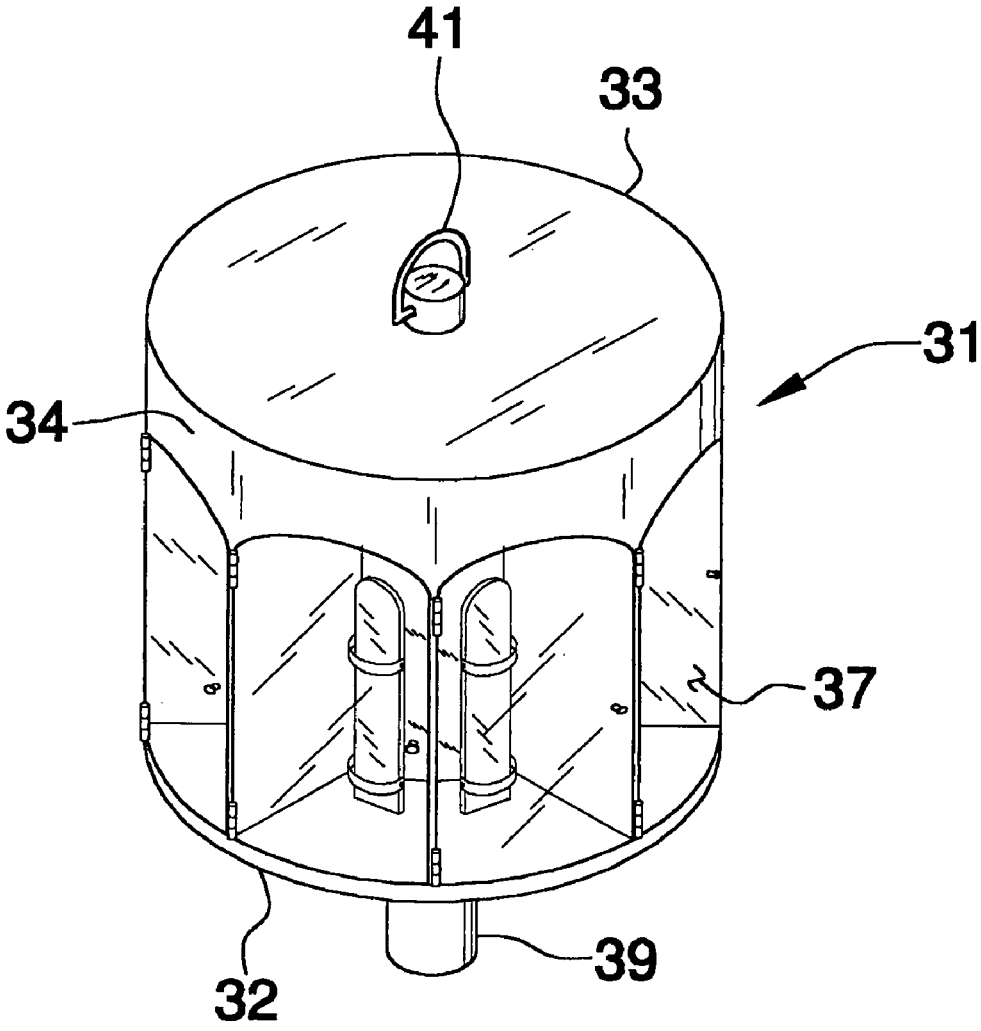
FIG. 2 is a perspective view of the top housing of the present invention.
Figure 3:
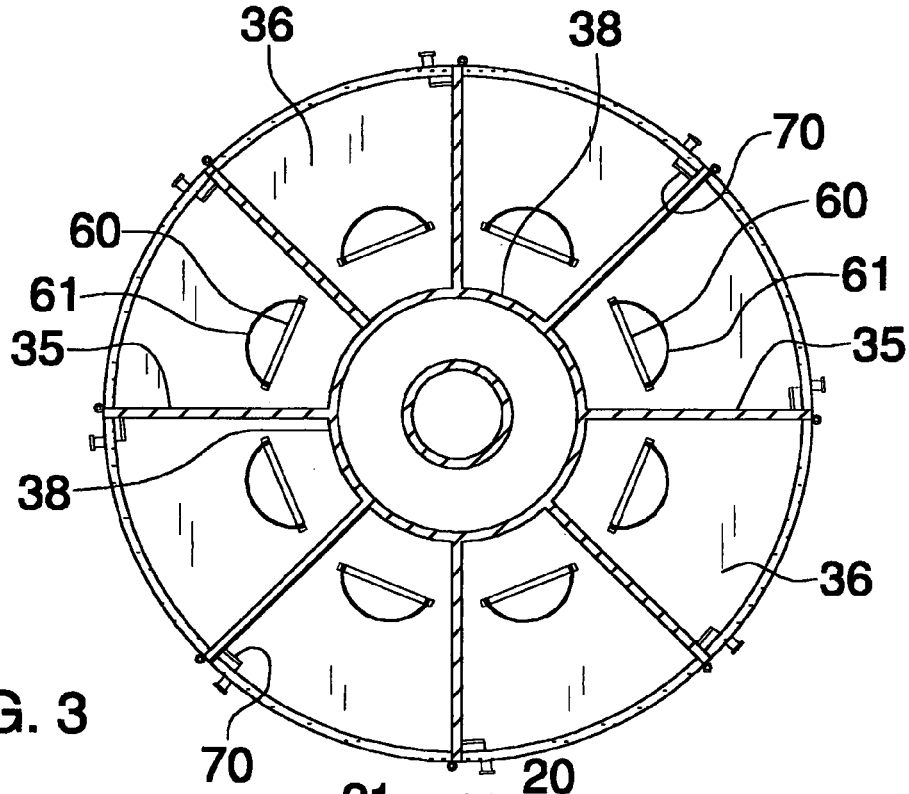
FIG. 3 is a cross-sectional view taken along line 3—3 of FIG. 1 of the present invention.

With reference now to the drawings, and in particular to FIGS. 1 through 6 thereof, a new doll holding device embodying the principles and concepts of the present invention and generally designated by the reference numeral 10 will be described.

As best illustrated in FIGS. 1 through 6, the accessory and doll holding assembly 10 generally includes a base housing 12 having a bottom wall 13, a top wall 14 and a peripheral wall 15 extending between and being attached to the top 14 and bottom 13 walls. A plurality of dividing walls 16 is positioned within the base housing 12 such that a central section 17 is defined and a plurality of outer sections is defined. Each of the outer sections is positioned adjacent to the peripheral wall 15. Two of the outer sections define clothes hanging sections 18 and a remaining number of the outer sections defining drawer sections 19. It is preferred that there are at two drawer sections 19 and up to four drawer sections. In the case of two drawer sections, adjacent sections shown in FIG. 4 would be combined into one section. The peripheral wall 15 of each of the clothes hanging sections 18 has a substantially transparent door 20 therein. Magnetic closures 70 attached to the doors 20 and the dividing walls 16 may be used for holding the doors in a closed position, though latches may also be utilized. The door are preferably substantially transparent.

Each one of a pair of horizontal rods 21 is mounted in one of the clothes hanging sections 18. Each of a plurality of drawers 22 is removably extended through the peripheral wall 15 and mounted in one of the drawer sections 19. It is preferred that each of the drawer sections 19 has a plurality of drawers 22 positioned therein. A centrally disposed well 23 extends into the top wall 14. Preferably, the top 14 and bottom 13 walls have a generally circular shape. The base housing 12 preferably has a height between 10 inches and 16 inches. Preferably the top 14 and bottom 13 walls have a diameter between 1¼ feet and 2 feet. A plurality of wheels 24 is conventional mounted on the bottom wall 13 of the base housing 12. The wheels 24 may optionally be removably from the base housing 12 for storage and transportation purposes.

A middle housing 30 and a top housing 31 are each included. Each of the middle 30 and top 31 housings has a lower wall 32, an upper wall 33 and a perimeter wall 34 extending between and attached to the lower 32 and upper 33 walls. A plurality of inner walls 35 is positioned in each of the middle 30 and top 31 housings. Each of the inner walls 35 radially extends outwardly from a central area to the perimeter walls 34 such that a plurality of compartments 36 are defined. The compartments 36 preferably have a substantially equal size and the plurality of compartments 36 is preferably includes at least six compartments 36 and more preferably includes eight compartments 36. Each of the perimeter walls 34 has a plurality of substantially transparent doors 37 therein for selectively accessing an interior of each of the compartments 36. Ideally, each of the compartments 36 includes one of the doors 37. Each of the compartments 36 has a rear wall 38 positioned opposite of a respective one of the perimeter walls 34. Each of the rear walls 38 has a mirrored surface. Each one of a pair of posts 39 is attached to and extends downwardly from one of the lower walls 32 of the middle 30 and top 31 housings. The upper wall 33 of the middle housing 30 has a centrally disposed well 40 therein.

Figure 4:
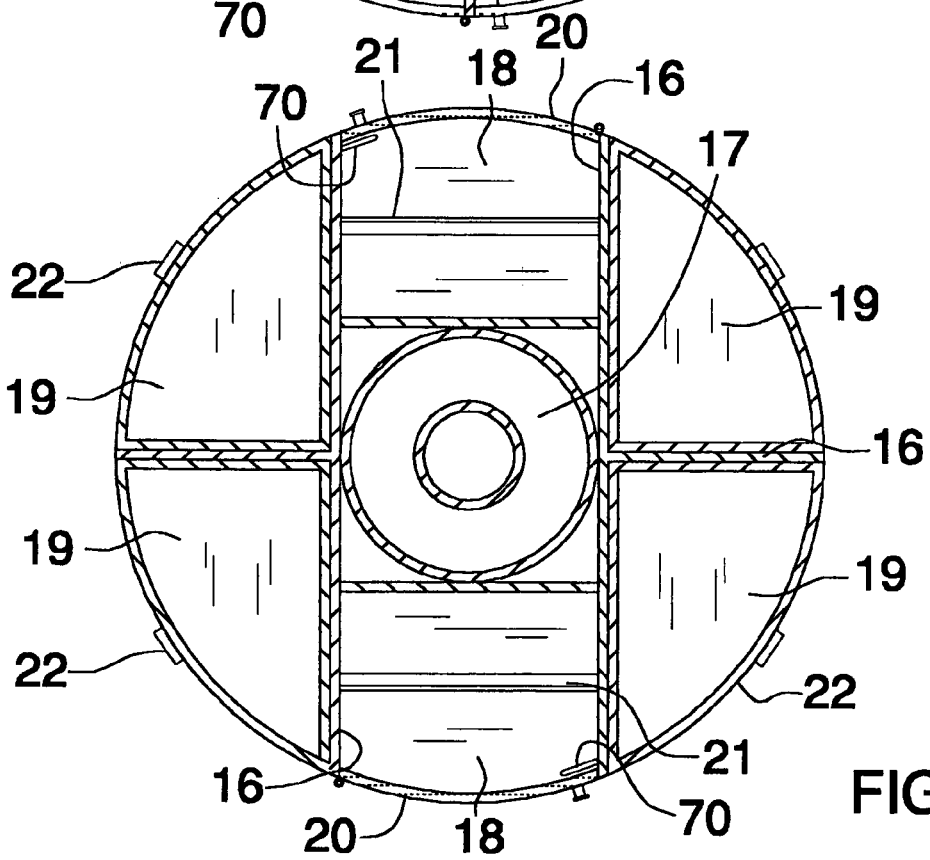
FIG. 4 is a cross-sectional view taken along line 4—4 of FIG. 1 of the present invention.
Figure 5:
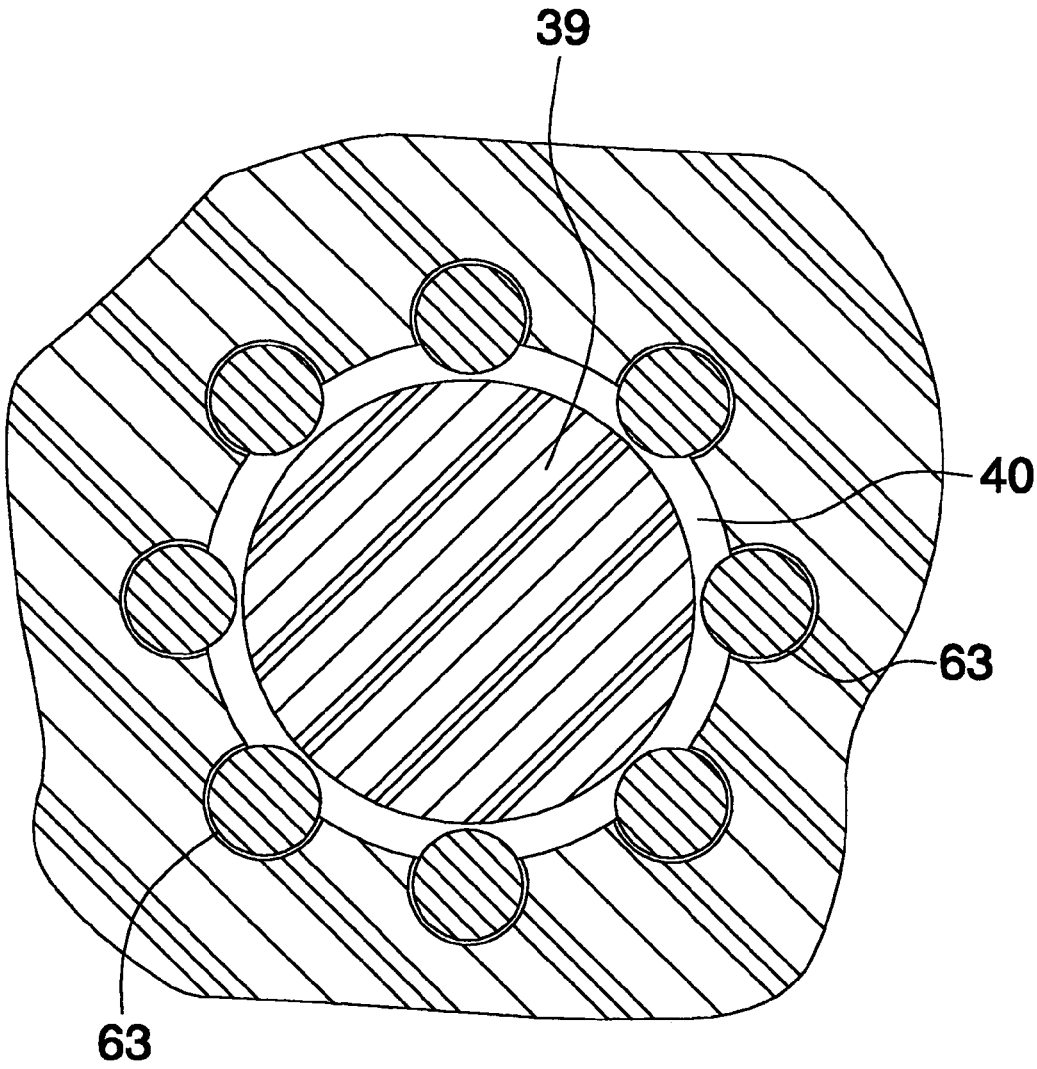
FIG. 5 is a cross-sectional view taken along line 5—5 of FIG. 1 of the present invention.
Figure 6:
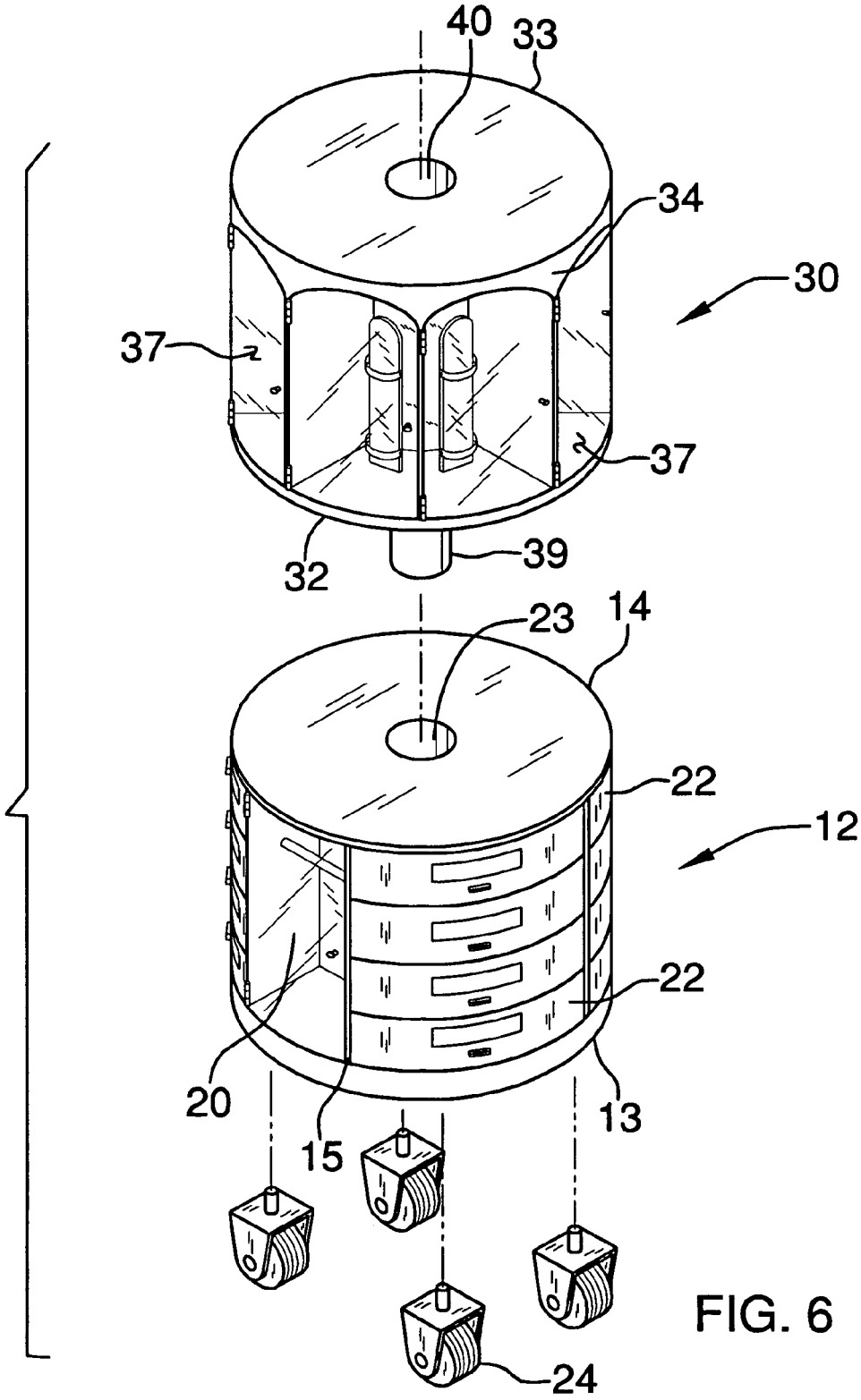
FIG. 6 is a perspective view of the base housing and middle housing of the present invention.

A handle 41 is attached to the upper wall 33 of the top housing 31. The handle is preferably constructed of a clear plastic or crystal material. Each of the upper 33 and lower 32 walls has a circular shape and has substantially a same size as the top 13 and bottom 14 walls. It is preferred that all of the doors 20, 37 in the housings 12, 30, 31, as well as the drawers 22, have arcuate outer surfaces to match the arc of the top 13 and bottom 14 walls. The rods may be straight, as shown in FIG. 4, or, alternatively, they may be arcuate so that they follow the contour of the doors 20. The doors 37 in the middle 30 and top 31 housings may also utilize magnetic closures 70.

Each of a plurality of mountings 60 is adapted for holding a doll in a vertical orientation. Each of the mountings 60 is positioned in one of compartments 36 such that each of the compartments 36 has one mounting 60 positioned therein. The mountings 60 each preferably comprise a vertically orientated plate that is made of a substantially transparent material. A plurality of bands 61 is attached to each of the plates for releasably securing a doll to the plates.

In use, each of the posts 39 may be selectively extended into one of the wells 23, 40 as needed. For this reason, it is envisioned that multiple middle housings 30 may be provided and in this sense the assembly 10 is modular. The drawers 22 are used primarily for holding doll accessories while doll clothes may be hung on the horizontal rods 21 on miniature hangers. The dolls themselves may be positioned within the compartments 36 and held in a vertical orientation with the mountings 60. The mountings 60 are transparent and the compartments 36 have rear walls 38 having a mirrored surface so that a person viewing the doll from the front may see the back side of the doll. It is envisioned also that the inner walls 35 may also be transparent to better view the dolls. The doors 20, 37 likewise, are transparent to offer better viewing of the contents of the housings 12, 30, 31. The wells 23, 40 may each have a side wall having bearings 63 rotatably mounted therein. When the posts 39 are placed into the wells, they abut the bearings 63 and such that the bearings 63 aid in the rotation of the housings 12, 30, 31 with respect to each other.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular doll display and accessory holding assembly comprising:

a base housing having a bottom wall, a top wall and a peripheral wall extending between and attached to said top and bottom walls, a plurality of dividing walls being positioned within said base housing such that a central section is defined and a plurality of outer sections is defined, each of said outer sections being positioned adjacent to said peripheral wall, two of said outer sections defining clothes hanging sections and a remaining number of said outer sections defining drawer sections, said peripheral wall of each of said clothes hanging sections having a substantially transparent door therein, each of a plurality of drawers being removably extended through said peripheral wall and mounted in each one of said drawer sections, a centrally disposed well extending into said top wall;

a middle housing and a top housing, each of said middle and top housings having a lower wall, an upper wall and a perimeter wall extending between and attached to said lower and upper walls, a plurality of inner walls being positioned in each of said middle and top housings, each of said inner walls radially extending outwardly from a central area to said perimeter walls such that a plurality of compartments are defined, each of said perimeter walls having a plurality of substantially transparent doors therein for selectively accessing an interior of each of said compartments, wherein each of said compartments includes one of said doors;

a pair of posts, one post from said pair of posts being attached to and extending down from said lower wall of said middle housing and said top housing respectively, said upper wall of said middle housing and said top wall of said base housing having a centrally disposed well therein, a handle being attached to said upper wall of said top housing; and wherein said post of said top housing may be selectively extended into either of said wells, and said post of said middle housing may be extended into said well of said base housing.

2. The assembly of claim 1, further including a pair of horizontal rods, each of said rods being mounted in one of said clothes hanging sections.

3. The assembly of claim 1, further including a rear wall being mounted in each of said compartments and being positioned opposite of a respective one of said perimeter walls, each of said rear walls having a mirrored surface.

4. The assembly of claim 3, further including a plurality of mountings, each of said mountings being adapted for holding a doll in a vertical orientation, each of said mountings being positioned in one of compartments.

5. The assembly of claim 4, wherein each of said mountings comprises a vertically orientated plate, a plurality of bands being attached to each of said plates for releasably securing a doll to said plates, each of said plates comprising a substantially transparent material.

6. The assembly of claim 5, further including a plurality of wheels being mounted on said bottom wall of said base housing.

7. The assembly of claim 1, further including a plurality of mountings, each of said mountings being adapted for holding a doll in a vertical orientation, each of said mountings being positioned in one of compartments.

8. The assembly of claim 7, wherein each of said mountings comprises a vertically orientated plate, a plurality of bands being attached to each of said plates for releasably securing a doll to said plates.

9. The assembly of claim 1, further including a plurality of wheels being mounted on said bottom wall of said base housing.

10. A modular doll display and accessory holding assembly comprising:

a base housing having a bottom wall, a top wall and a peripheral wall extending between and attached to said top and bottom walls, a plurality of dividing walls being positioned within said base housing such that a central section is defined and a plurality of outer sections is defined, each of said outer sections being positioned adjacent to said peripheral wall, two of said outer sections defining clothes hanging sections and a remaining number of said outer sections defining drawer sections, said peripheral wall of each of said clothes hanging sections having a substantially transparent door therein, a centrally disposed well extending into said top wall, said top and bottom walls having a generally circular shape;

a pair of horizontal rods, each of said rods being mounted in one of said clothes hanging sections;

a plurality of drawers, each of said drawers being removably extended through said peripheral wall and mounted in each one of said drawer sections, each of said drawer sections having a plurality of drawers positioned therein;

a middle housing and a top housing, each of said middle and top housings having a lower wall, an upper wall and a perimeter wall extending between and attached to said lower and upper walls, a plurality of inner walls being positioned in each of said middle and top housings, each of said inner walls radially extending outwardly from a central area to said perimeter walls such that a plurality of compartments are defined, each of said perimeter walls having a plurality of substantially transparent doors therein for selectively accessing an interior of each of said compartments, wherein each of said doors opens into one of said compartments, each of said compartments having a rear wall positioned opposite of a respective one of said perimeter walls, each of said rear walls having a mirrored surface;

a pair of posts, one post from said pair of posts being attached to and extending down from said lower wall of said middle housing and said top housing respectively, said upper wall of said middle housing and said top wall of said base housing having a centrally disposed well therein, a handle being attached to said upper wall of said top housing, each of said upper and lower walls having a circular shape and having substantially a same size as said top and bottom walls;

a plurality of mountings, each of said mountings being adapted for holding a doll in a vertical orientation, each of said mountings being positioned in one of compartments such that each of said compartments has one mounting positioned therein, each of said mountings comprising a vertically orientated plate, a plurality of bands being attached to each of said plates for releasably securing a doll to said plates, each of said plates comprising a substantially transparent material;

a plurality of wheels being mounted on said bottom wall of said base housing; and wherein said post of said top housing may be selectively extended into either of said wells, and said post of said middle housing may be extended into said well of said base housing.

* * * * *